US005159388A

United States Patent [19]

Yoshiyama et al.

[11] Patent Number: 5,159,388

[45] Date of Patent: Oct. 27, 1992

[54] IMAGE FORMING APPARATUS

[75] Inventors: Tsugihito Yoshiyama, Toyohashi; Hiroshi Okamoto, Shinshiro; Moriyoshi Matsushiro, Nagoya; Masataka Oda; Masayasu Haga, both of Toyohashi, all of Japan

[73] Assignee: Minolta Camera Co., Ltd., Osaka, Japan

[21] Appl. No.: 720,938

[22] Filed: Jun. 25, 1991

[30] Foreign Application Priority Data

Jun. 27, 1990 [JP] Japan ..... 2-169164

[51] Int. Cl.[5] ..... G03G 21/00

[52] U.S. Cl. ..... 355/208; 355/209; 355/211; 355/246

[58] Field of Search ..... 355/206, 209, 208, 228, 355/229, 216, 211, 219, 221, 225, 245, 265; 250/324, 325, 326; 430/35, 55; 361/225

[56] References Cited

U.S. PATENT DOCUMENTS

| | | | |
|---|---|---|---|
| 3,961,193 | 6/1976 | Hudson | 250/324 |
| 4,305,651 | 12/1981 | Umezawa et al. | 355/219 |
| 4,326,796 | 4/1982 | Champion et al. | 355/219 X |
| 4,600,668 | 7/1986 | Nauazawa | 430/31 |
| 5,008,711 | 4/1991 | Sakamoto et al. | 355/206 |

FOREIGN PATENT DOCUMENTS

| | | | |
|---|---|---|---|
| 53-15834 | 2/1978 | Japan . | |
| 59-69774 | 4/1984 | Japan . | |
| 0138267 | 6/1986 | Japan | 355/208 |
| 61-29505 | 7/1986 | Japan . | |
| 0279367 | 12/1987 | Japan | 355/208 |

*Primary Examiner*—A. T. Grimley
*Assistant Examiner*—Christopher Horgan
*Attorney, Agent, or Firm*—Willian Brinks Olds Hofer Gilson & Lione

[57] ABSTRACT

An image forming apparatus comprising a charging section for uniformly charging a surface of a photoconductive body; an image forming section for forming an image on the photoconductive body charged by the charging section; a detecting section for detecting an influx current flowing to the photoconductive body when the photoconductive body is charged by the charging section; and a control section for controlling the image forming section so as to stabilize a quality of images formed by the image forming section.

39 Claims, 8 Drawing Sheets

IMAGE FORMING APPARATUS

BACKGROUND OF THE INVENTION (1) Field of the Invention

This invention relates to an image forming apparatus equipped with a photoconductive body which is gradually worn away as an image forming procedure is repeated many times (for example, a photoconductive drum having a surface formed of an organic photoconductive layer), especially to an image forming apparatus for compensating the sensitivity of the photoconductive body which would be deteriorated as the photoconductive body is worn away.

(2) Description of the Related Art

In a conventional copier equipped with a photoconductive drum, a surface thereof formed of an organic photoconductive layer is gradually worn away by a friction when a cleaning blade scratches off the residual toner on the surface after an image is transferred onto a copying paper.

Such a phenomenon deteriorates the sensitivity of the photoconductive drum for the following reason.

A surface potential $V_0$ of the drum applied by a main charger and a thickness d of the organic photoconductive layer of the drum have the following relationship:

$$Q = CV_0 = \epsilon_0 \cdot \epsilon_r \frac{1}{d} V_0 \quad (1)$$

where

Q: charge amount applied to the photoconductive drum per a unit area

C: capacitance per a unit area of the organic photoconductive layer $\epsilon_0$: dielectric constant in vacuum $\epsilon_r$: relative dielectric constant in the organic photoconductive layer As apparent from Equation (1), if the photoconductive drum is charged with the same surface potential $V_0$ before and after the thickness d is reduced, the charge is accumulated in a larger amount in the latter case.

Accordingly, even if the photoconductive drum is exposed by the same light amount after the repetition of the image forming procedure as on the initial stage, the potential at the exposed portion is not lowered enough. In the normal development, such a phenomenon adheres an unnecessary toner on the exposed portion, as a result of which the copying paper gets fogging in a blank area. In the reverse development such as in a laser copier, the image density is lowered. In other words, the sensitivity of the photoconductive drum is lowered.

When the photoconductive drum is worn away much more and completes a life thereof, black streams appear on the copying paper or half-tone images are blurred. Since the life expectancy cannot be determined accurately in a conventional copier, the drum is renewed when the drum is still in a good condition or after the above problems occur.

Japanese Patent Publication No. 61-29505 has disclosed a copier for compensating the sensitivity of the photoconductive drum. The number of copies, the paper size and the exposure time are detected, and the copying conditions such as the light amount are adjusted in accordance with the predetermined relationship between each detected value and the characteristics of the photoconductive layer of the drum. In this construction, wherein a change in the thickness of the photoconductive layer is not directly detected, the compensation precision is not high.

According to U.S. Pat. No. 3,961,193, an influx current $I_{pc}$, which flows to the photoconductive layer from the back side thereof and has the same amount as a charging current from the main charger to the surface of the photoconductive layer, is measured, and the output of the main charger is adjusted by comparing the measured $I_{pc}$ and the predetermined reference value. In such a construction, the surface potential $V_0$ of the photoconductive layer can be kept at a certain level as long as the thickness of the photoconductive layer is kept the same. However, the reduction in the thickness d accompanies the decline in the surface potential $V_0$. As a result, the image density is not high enough in the normal development while the copying paper gets fogging in the reverse development.

SUMMARY OF THE INVENTION

Accordingly, this invention has an object of offering an image forming apparatus for remarkably improving the image quality by preventing fogging or fluctuations in the image density which occur when the photoconductive layer is worn away.

The above object is fulfilled by an image forming apparatus comprising a charging section for uniformly charging a surface of a photoconductive body; an exposure section for exposing an image of a document on the photoconductive body; a developing section for developing the image formed on the photoconductive body; a detecting section for detecting an influx current flowing to the photoconductive body when the photoconductive body is charged by the charging section; and a control section for controlling the exposure section and/or the developing section based on a detecting result of the detecting section so as to stabilize a quality of images formed on the photoconductive body.

The photoconductive body may be organic.

According to the above constructions, the detecting section detects the influx current flowing to the photoconductive body being charged by the charging section, and then the control section controls the light amount emitted from the exposure section and/or the developing bias voltage of the developing section. In this way, the sensitivity of the photoconductive body is surely compensated.

Another object of this invention is to offer an image forming apparatus for assuring an excellent sensitivity compensation of the photoconductive layer regardless of temperature change or humidity change.

The above object is fulfilled by an image forming apparatus comprising a scorotron type charger for uniformly charging a surface of a photoconductive body; a switching section for selecting one of at least two grid voltages of the charger; an exposure section for exposing an image of a document on the photoconductive body; a developing section for developing the image formed by the exposure section; a detecting section for detecting influx currents flowing to the photoconductive body when the photoconductive body is charged by the charger with the respective grid voltages being switched over; a calculating section for calculating thickness of a photoconductive layer of the photoconductive body based on a detecting result of the detecting section; and a control section for controlling an amount of the light used in the exposure section and/or the developing bias voltage of the developing section.

According to the above constructions, the exposure section and/or the developing section is controlled based on the influx currents corresponding to at least two grid voltages. Even if an offset current is included in the influx current by the temperature change, the sensitivity compensation of the photoconductive body is not affected by the offset current.

Still another object of this invention is to offer an image forming apparatus for appropriately renewing the photoconductive drum in accordance with the life expectancy of the photoconductive layer judged by the reduction of the thickness thereof.

The above object is fulfilled by an image forming apparatus comprising a charging section for uniformly charging a surface of a photoconductive body; an image forming section for forming an image on the photoconductive body charged by the charging section; a detecting section for detecting an influx current flowing to the photoconductive body when the photoconductive body is charged by the charging section; a calculating section for calculating a thickness of a photoconductive layer of the photoconductive body based on a detecting result of the detecting section; and an estimating section for estimating a life expectancy of the photoconductive layer based on a calculating result of the calculating section.

According to the above constructions, the calculating section calculates the thickness of the photoconductive body based on the influx current, and the estimating section estimates the life expectancy of the photoconductive layer to warn an operator when the photoconductive layer completes the life thereof or inform an operator how many more copies can be made. The photoconductive body can be renewed appropriately.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF THE PREFERRED EMBODIMENTS

Embodiment I

A first embodiment according to this invention will be described referring to FIGS. 1 through 4.

Overall construction and operation of the copier

Figure 1:
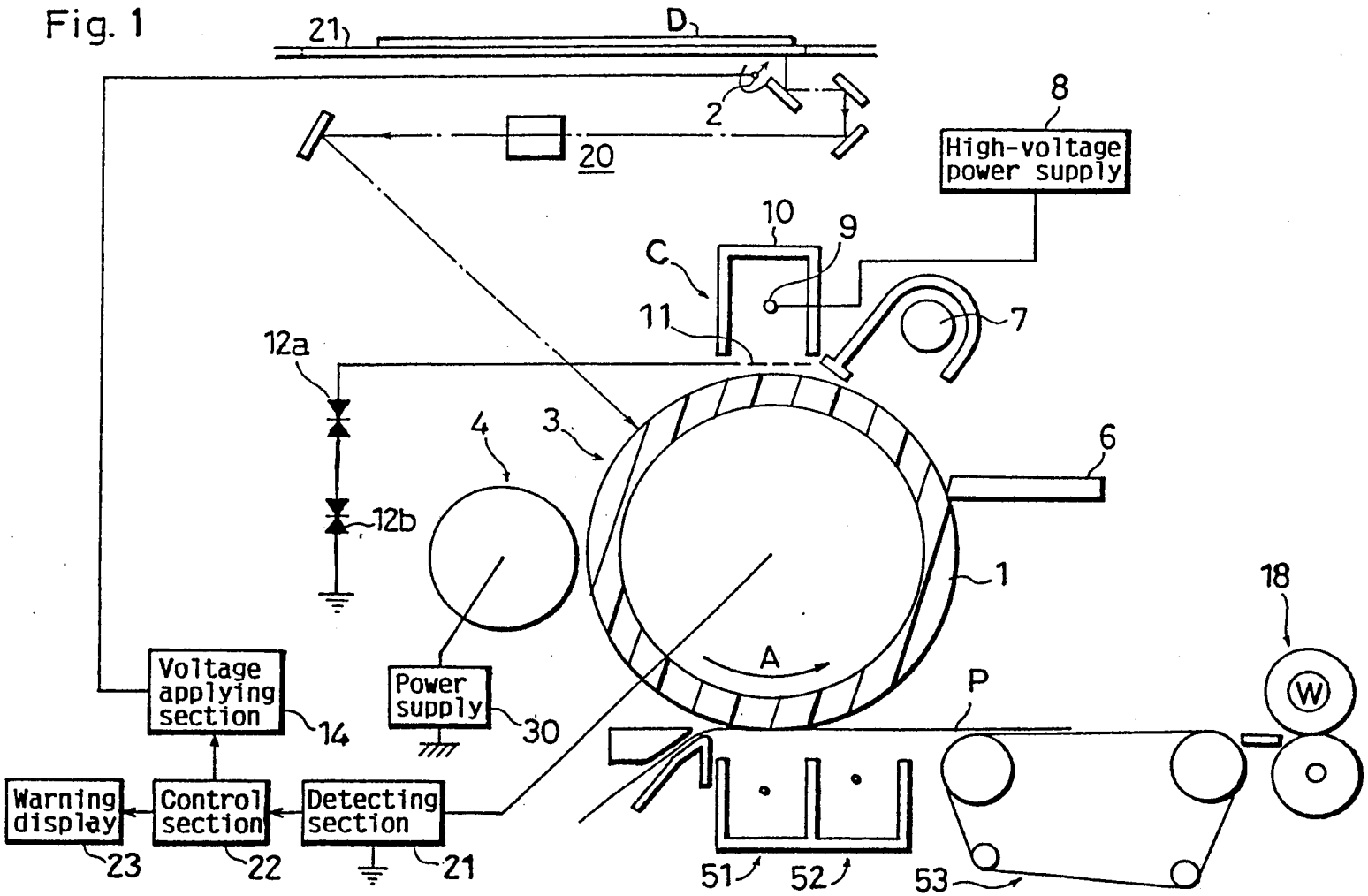
FIG. 1 is a schematic view of a copier as a first embodiment of this invention.

A copier as the first embodiment has a construction as shown in FIG. 1. When a document D is set on a glass document table 21 and a print key (not shown) is turned on, a light from an exposure lamp 2 illuminates the document D, and a photoconductive drum 1 is exposed by the reflected light through an optical system 20 comprising mirrors and a lens.

A light amount to be emitted from the exposure lamp 2 is adjusted by a voltage applying section 14 in the following way.

Figure 2:
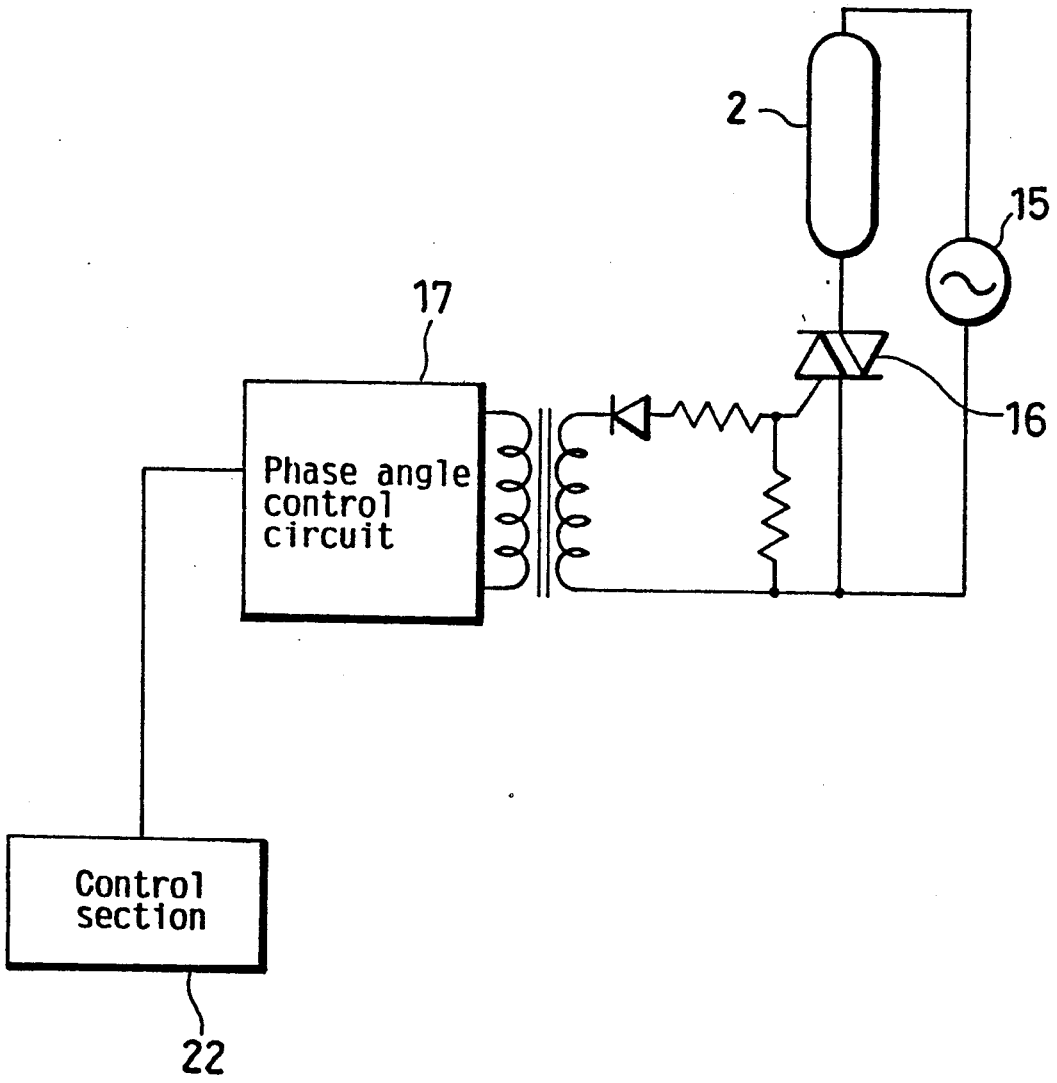
FIG. 2 is a circuit diagram of a voltage applying section.

As shown in FIG. 2, the voltage applying section 14 comprises a triac 16 interposed between the exposure lamp 2 and an AC power source 15, and a phase angle control circuit 17. The triac 16 is turned on or off by the phase angle control circuit 17 in accordance with a timing signal of a phase angle corresponding to a control signal sent from a control section 22, whereby an AC power sent from the AC power source 15 to the exposure lamp 2 is adjusted.

The photoconductive drum 1, which is rotatable in a direction of an arrow A (FIG. 1), comprises a conductive base (formed of Al or the like) and an organic photoconductive layer coated thereon. The organic photoconductive layer comprises a CGL (charge generating layer) and a CTL (charge transporting layer). A main charger C opposed to the drum 1 uniformly charges negative a surface of the photoconductive drum 1 prior to exposure. Then, an electrostatic latent image is formed on the surface of the drum 1 through the exposure. The electrostatic latent image is provided with a toner which is friction-charged positive by a developing device 4 which has a bias voltage applied by a power supply 30, whereby a toner image is formed on the drum 1.

In synchronization with the formation of the toner image, a copying paper P is sent to a transferring section, whereby a reverse side of the paper P is charged in the opposite polarity to the toner by a transfer charger 51. In this way, the toner image on the drum 1 is transferred on the paper P.

The paper P has the charge thereon removed by a separation charger 52 (AC corotron) and is separated from the drum 1 due to the paper's own firmness. Then, the paper P is sent to a fixing device 18 by a transporting device 53, whereby the toner image is fixed on the paper P and delivered outside.

The residual toner on the drum 1 is scratched off by a cleaning blade 6, and the residual charge on the drum 1 is removed by an eraser lamp 7.

Construction and operation of the main charger C and its vicinity

The main charger C of the scorotron type comprises a charging wire 9 connected to a high-voltage power supply 8, a casing 10 which is a rectangular box with a bottom thereof open and accommodates the charging wire 9, and a grid electrode 11 interposed between the charging wire 9 and the photoconductive drum 1. The grid electrode 11 is provided for keeping a potential $V_0$ of the surface of the drum 1 at a certain level. The grid electrode 11 is connected in series to two varistors 12*a* and 12*b*, and an end of the varistor 12*b* is grounded. The varistors 12*a* and 12*b* are resistance elements whose voltage-current characteristics are non-linear. A grid voltage $V_g$ of the grid electrode 11 is kept at a level determined by the combination of the varistors 12*a* and 12*b*. Since this means the potential $V_0$ of the surface of the drum 1 is substantially the same as the grid voltage $V_g$, Formula (2) is obtained.

$$V_0 \approx V_g = V_a + V_b \quad (2)$$

where $V_a$: voltage across both ends of the varistor 12a

$V_b$: voltage across both ends of the varistor 12b

Sensitivity compensation

In this embodiment, the sensitivity of the photoconductive drum 1 is compensated by detecting the change in the thickness of the photoconductive layer of the drum 1 and thus adjusting the light amount emitted from the exposure lamp 2. The thickness of the photoconductive layer is assumed by an influx current $I_{pc}$.

Figure 3:
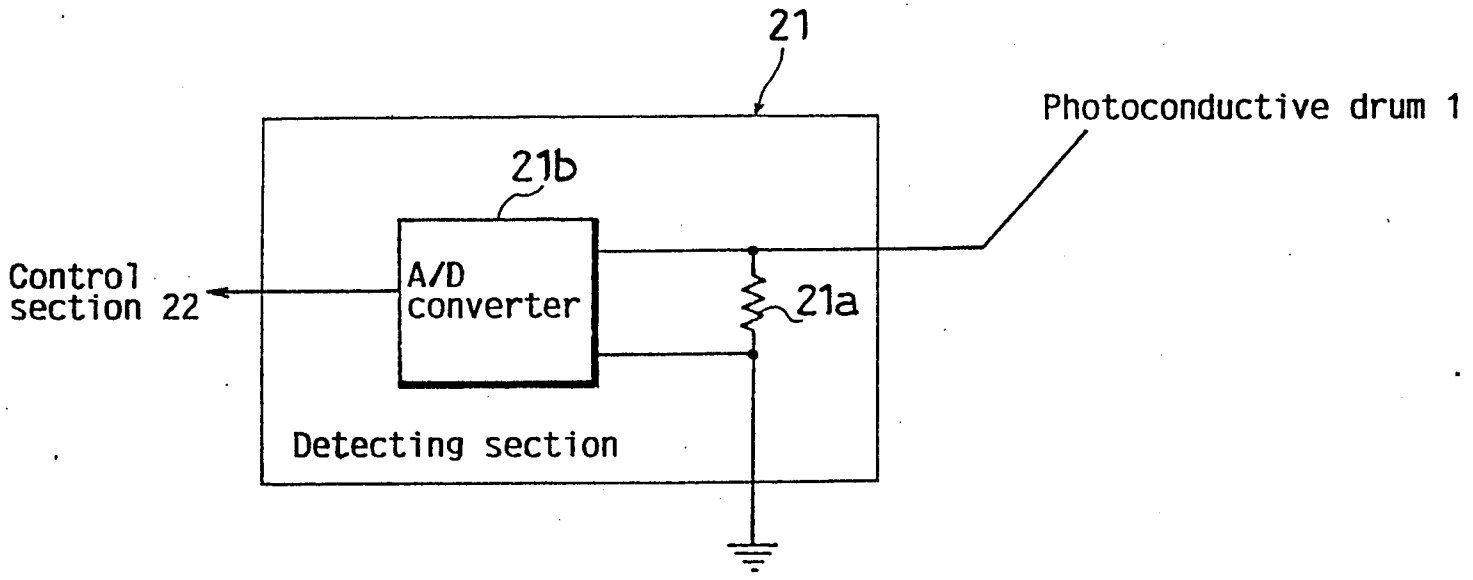
FIG. 3 is a block diagram of a detecting section.
Figure 4:
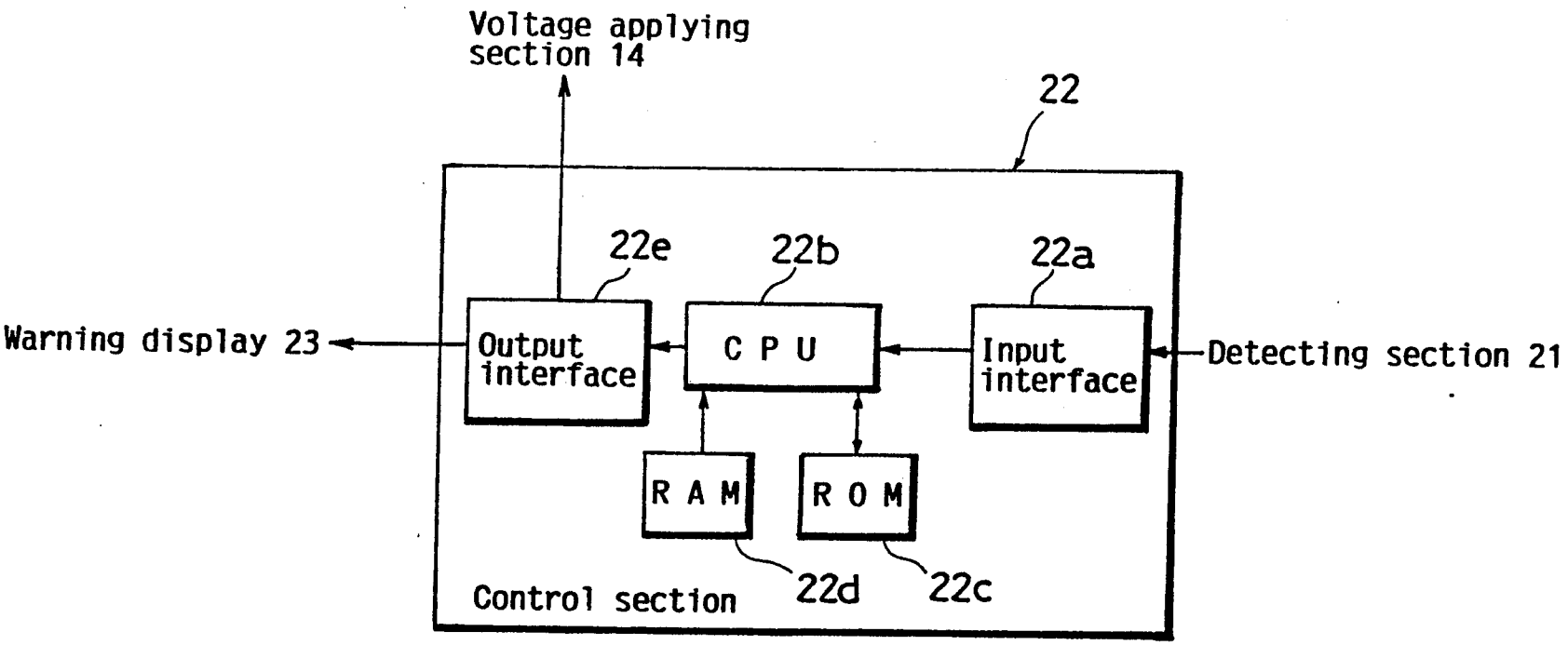
FIG. 4 is a block diagram of a control section.

The influx current $I_{pc}$ is detected by a detecting section 21 with the drum 1 being rotated and the main charger C and the eraser lamp 7 being driven. As shown in FIG. 3, the detecting section 21 comprises a resistance 21a and an A/D converter 21b. The resistance 21a grounds the conductive base of the drum 1, and the A/D converter 21b converts voltages generated at both ends of the resistance 21a and sends the converted voltages to the control section 22.

The control section 22, which comprises an input interface 22a, a CPU 22b, a ROM 22c, a RAM 22d and an output interface 22e (FIG. 4), obtains an optimum light amount to be emitted from the exposure lamp 2 and the thickness d of the photoconductive layer based on the voltages sent from the A/D converter 21b.

The principle of the sensitivity compensation of the photoconductive drum 1 will be explained hereinafter.

The influx current $I_{pc}$ supplied to the photoconductive layer and the charge amount Q accumulated in the photoconductive layer, both per a unit area, have the following relationship:

$$Q \approx k_1 \cdot I_{pc} \quad (3)$$

where $k_1$ is a constant determined by a length of the drum 1 in an axial direction thereof and the rotating speed of the drum 1.

From Equations (1), (2) and (3), the thickness d and the influx current $I_{pc}$ have the following relationship:

$$d \approx \frac{\epsilon_0 \cdot \epsilon_r \cdot V_g}{k_1 \cdot I_{pc}} = k_2 \frac{V_g}{I_{pc}} \quad (4)$$

where $k_2$ is a constant ($=\epsilon_0 \cdot \epsilon_r / k_1$). The grid voltage $V_g$ is kept at a certain level for the above reasons in the scorotron type main charger C.

As apparent from Equation (4), the thickness d is obtained by the influx current $I_{pc}$ although indirectly.

The thickness d and the sensitivity of photoconductive layer have the following relationship:

$$\frac{\text{Sensitivity after image forming repetition}}{\text{Initial sensitivity}} = \left\{ \frac{\text{Thickness after image forming repetition}}{\text{Initial thickness}} \right\}^{\alpha} \quad (5)$$

"$\alpha$", which is a constant obtained from the relationship between a carrier generation efficiency in the CGL and an electric field strength ($V_0/d$), varies in accordance with the kind of the photoconductive layer. In the organic photoconductive layer used in this embodiment (a lamination of a disazo system charge generating layer and a hydrazone system charge transporting layer), $\alpha = 0.8$.

Accordingly, $$E_0^1 = \left( \frac{d^0}{d^1} \right)^{0.8} E_0^0 \quad (6)$$

where $d^0$: initial thickness $d^1$: thickness after image forming repetition $E_0^0$: initial optimum light amount $E_0^1$: optimum light amount after image forming repetition The initial optimum light amount, which is set when the photoconductive drum 1 is mounted in the copier, is stored in a non-volatile memory provided in the copier.

The optimum light amount after image forming repetition is also expressed by:

$$E_0^1 = \left( \frac{I_{pc}^1}{I_{pc}^0} \right)^{0.8} E_0^0 \quad (7)$$

where $I_{pc}^0$: initial influx current $I_{pc}^1$: influx current after image forming repetition $I_{pc}^0$ is measured when the photoconductive drum 1 is mounted in the copier and stored in the non-volatile memory. Based on the measured influx current $I_{pc}^1$, the control section 22 executes the operation of Equation (7) to obtain $E_0^1$. Then, the control section 22 sends a predetermined control signal to the voltage applying section 14, whereby $E_0^1$ is set in the exposure lamp 2.

The control section 22 also determines the life expectancy of the photoconductive drum 1 based on the thickness d which has been obtained through the operation of Equation (4). The operator is notified that the photoconductive drum 1 should be renewed. When the photoconductive drum completes a life thereof, black streams appear on the copying paper or half-tone images are blurred. These problems are conspicuous when a 22 $\mu$m thick photoconductive layer gets 12 $\mu$m thick, for example.

How to determine the life expectancy will be described hereinafter.

If the present thickness $d^1$, which is estimated from Equation (4), exceeds the predetermined value, the control section 22 drives a warning display 23 to display a warning message or illuminate a warning lamp.

In another conceivable construction, the number of copies which have been made so far is stored, and the stored number and the present thickness $d^1$ are used to obtain how much thickness is taken away from the photoconductive layer per copy. Based on the obtained thickness, how many more copies can be made is determined and displayed.

Where the number of copies which have been made is $C_1$, the thickness which is taken away per copy is:

$$(d^0 - d^1)/C_1$$

Where the total number of copies is $C_{TOTAL}$ and the least possible thickness necessary for image forming is $d_E$, $$C_{TOTAL} = (d^0 - d_E)/\frac{d^0 - d^1}{C_1} = \frac{d^0 - d_E}{d^0 - d^1} \cdot C_1 \quad (8)$$

How many more copies can be made ($C_r$) is expressed $$C_r = \frac{d^0 - d_E}{d^0 - d^1} C_1 - C_1 = \frac{d^1 - d_E}{d^0 - d^1} C_1 \quad (9)$$

Cr is also obtained from Equations (4) and (9) based on the influx current $I_{pc}$.

Embodiment II

In the first embodiment, the optimum light amount $E_0^1$ is obtained based on the measured influx current $I_{pc}$. A second embodiment concerns a copier equipped with a photoconductive drum 1' including a organic photoconductive layer which generates an offset current $I_{po}$ (a kind of a lamination of a disazo system charge generating layer and a hydrazone system charge transporting layer).

Figure 5:
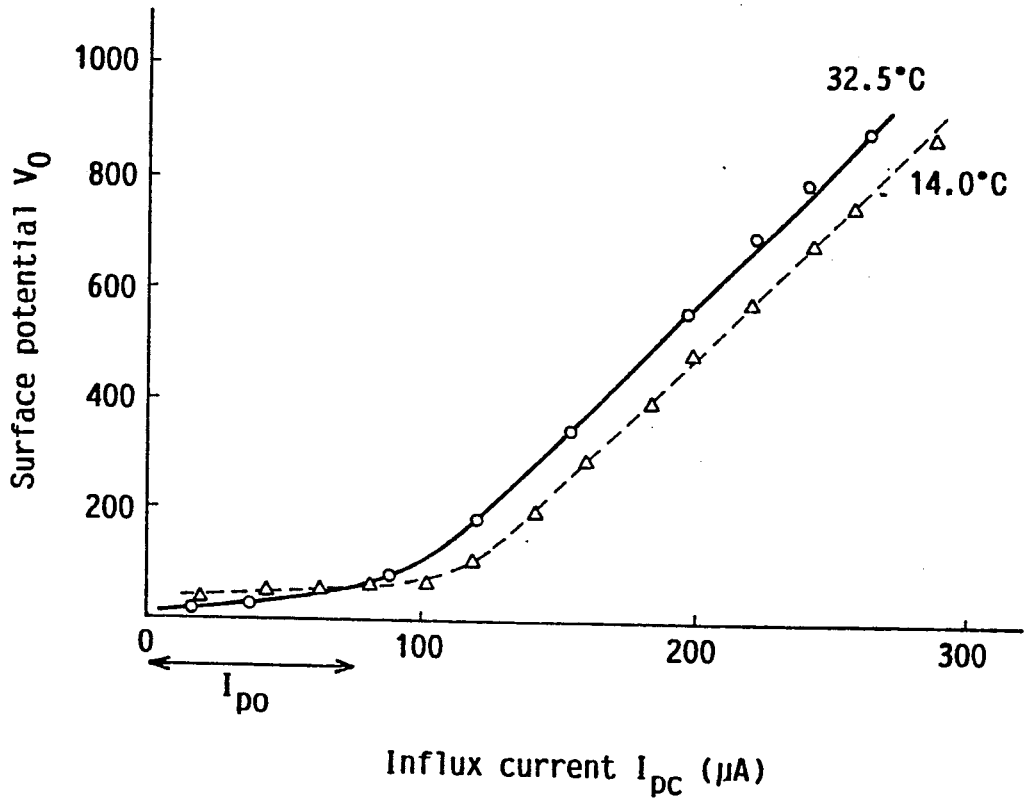
FIG. 5 is a graph showing the relationship between the surface potential and the influx current in a copier as a second embodiment.

As shown in FIG. 5, the offset current $I_{po}$, which does no contribution to the charging of the drum 1', is varied in accordance with the ambient temperature or humidity of the photoconductive layer. In such a case, the influx current $I_{pc}$ and the surface potential $V_0$ do not have the relationship mentioned in the first embodiment. The thickness d cannot obtained accurately unless the offset current $I_{po}$ is considered.

As shown in FIG. 5, the influx current $I_{pc}$ and the surface potential $V_0$ are in proportion to each other both at 32.5° C. and 14.0° C. where the surface potential $V_0$ is a certain level (200 V in this case) or above. In other words, the surface potential $V_0$, the grid voltage $V_g$ and the influx current $I_{pc}$ have the following relationship, with the same slope regardless of the temperature:

$$V_g \approx V_0 = \frac{d}{\epsilon_0 \cdot \epsilon_r} Q \approx \frac{d}{\epsilon_0 \cdot \epsilon_r} k_1 (I_{pc} - I_{po}) \quad (10)$$

$$\therefore V_g \approx V_0 \approx \frac{1}{k_2} d(I_{pc} - I_{po}) \quad (11)$$

It is said from Equation (11) that the slope of the line indicating the relationship between the surface potential $V_0$ and the influx current $I_{pc}$ is obtained by measuring the influx current $I_{pc}$ at least at two points in the area where the surface potential $V_0$ and the influx current $I_{pc}$ are in proportion to each other regardless of the amount of the offset current. The thickness d is estimated by that slope.

Figure 6:
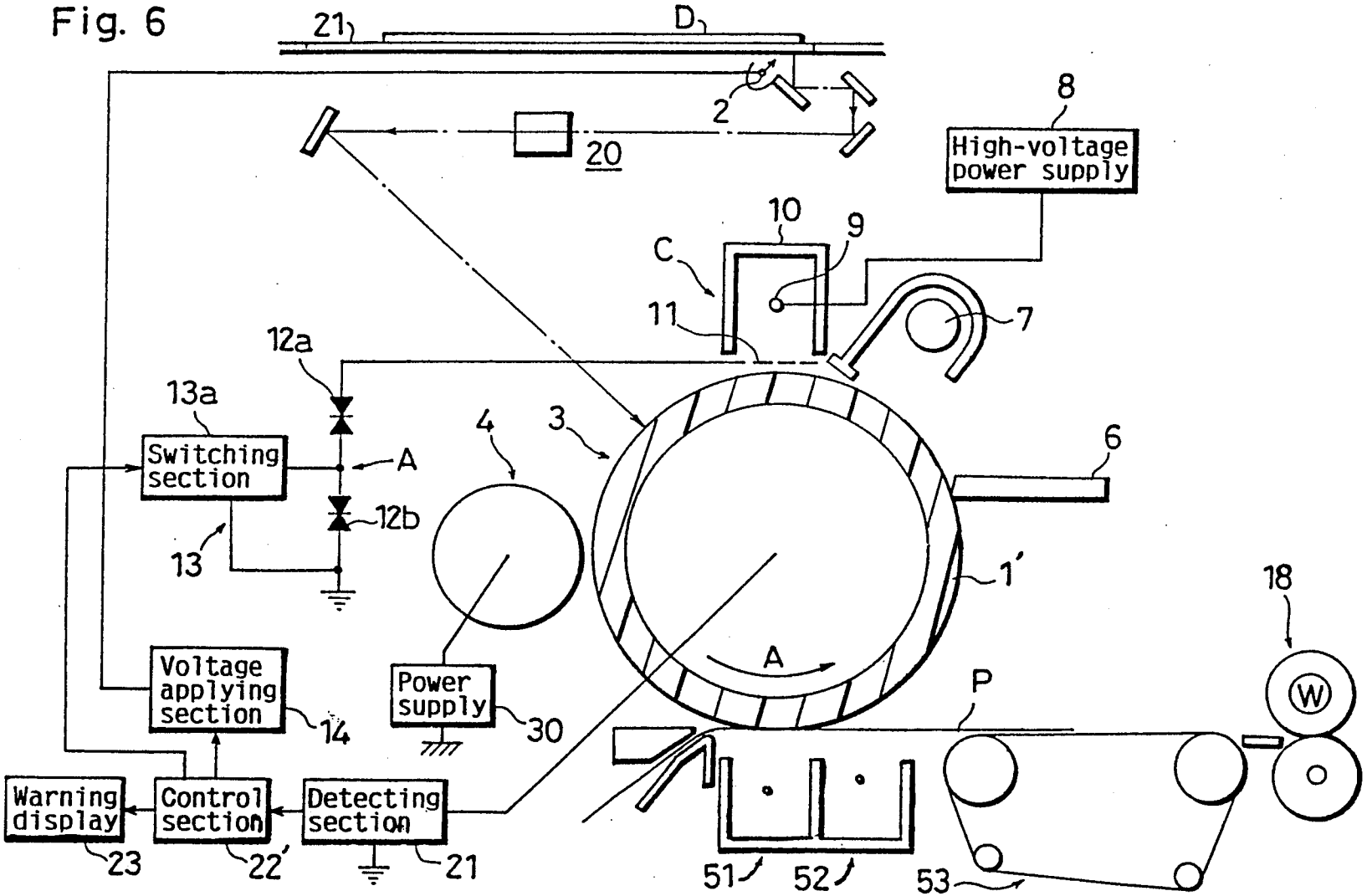
FIG. 6 is a schematic view of the copier as the second embodiment.

FIG. 6 shows a construction of such a copier. In addition to the elements of the first embodiment, the copier has a bypass circuit 13 for grounding a connecting point A of the varistors 12*a* and 12*b*. The bypass circuit 13 includes a switching section 13*a*, which deelectrifies the bypass circuit 13 by a command from a control section 22' in the normal copying mode. When the bypass circuit 13 is de-electrified, the grid electrode 11 of the main charger C is grounded through the varistors 12*a* and 12*b*, whereby the surface potential $V_0 = V_a + V_b$. When the bypass circuit 13 is electrified, the surface potential $V_0 = V_a$. In this way, the surface potential $V_0$ is switched over two steps, whereby detecting two levels of the influx current $I_{pc}$.

The detailed explanation will follow. The grid voltage $V_g$ is switched to $V_a$ or $V_a + V_b$ to detect the influx current $I_{pc(a)}$ or $I_{pc(a+b)}$ of each case. The relationship among the grid voltages $V_a$ and $V_{a+b}$ and the influx currents $I_{pc(a)}$ and $I_{pc(a+b)}$ is expressed by:

$$V_a \approx \frac{1}{k_2} d(I_{pc(a)} - I_{pc}) \quad (12)$$

$$V_a + V_b \approx \frac{1}{k_2} d(I_{pc(a+b)} - I_{pc}) \quad (13)$$

$$V_b \approx \frac{1}{k_2} d(I_{pc(a+b)} - I_{pc(a)}) \quad (14)$$

The thickness d, which is assumed from Equation (14), is expressed by:

$$d = \frac{k_2 V_b}{I_{pc(a+b)} - I_{pc(a)}} \quad (15)$$

From Equations (5) and (13), the optimum light amount $E_0^1$ for the above thickness is expressed by:

$$E_0^1 = \left( \frac{I^1_{pc(a+b)} - I^1_{pc(a)}}{I^0_{pc(a+b)} - I^0_{pc(a)}} \right)^{0.8} E_0^0 \quad (16)$$

where $I_{pc(a+b)}^0$: initial influx current corresponding to the grid voltage of $V_a + V_b$ $I_{pc(a+b)}^0$: initial influx current corresponding to the grid voltage of $V_a$ The control section 22' sends a predetermined control command signal to the voltage applying section 14 in accordance with Equation (16), whereby the light amount emitted from the exposure lamp 2 is adjusted. $I_{pc(a)}^0$ and $I_{pc(a+b)}^0$ are set when the photoconductive drum 1' is mounted in the copier and stored in the nonvolatile memory.

In the first and second embodiments, the sensitivity compensation is done by adjusting the light amount emitted from the exposure lamp 2. Such a compensation method stabilizes the high quality of images since the surface potential $V_0$ before exposure, the potential $V_i$ of the exposed portion and the developing bias voltage $V_B$ are kept the same.

Embodiment III

The sensitivity compensation can also be done by adjusting a developing bias voltage $V_B$.

Figure 7:
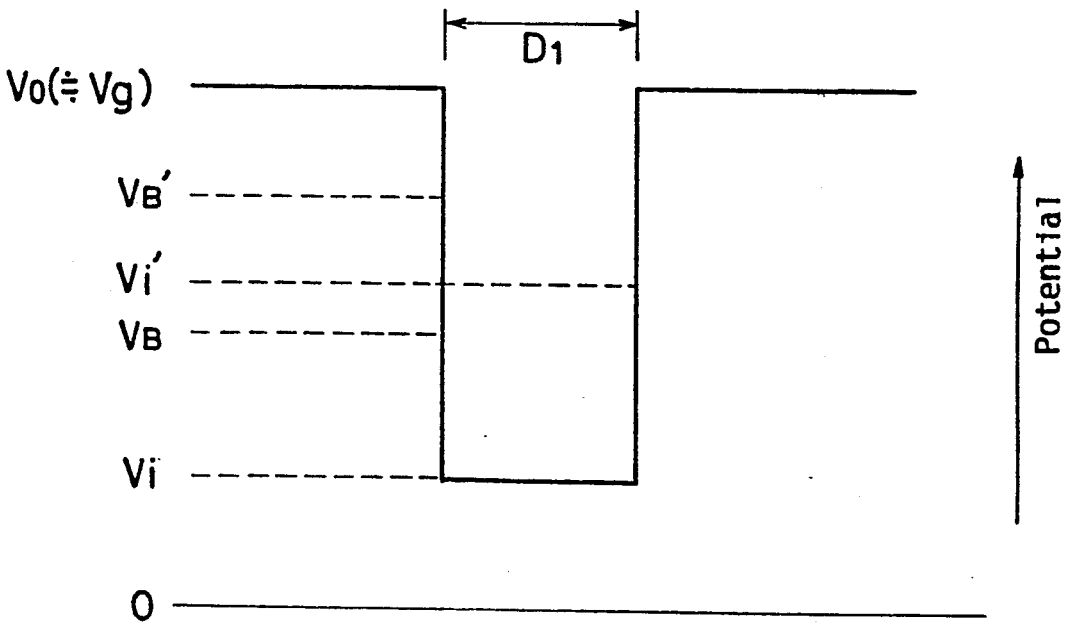
FIG. 7 is a view showing a principle of compensating the sensitivity of the photoconductive layer by adjusting the developing bias voltage.

FIG. 7 shows the principle of compensating the sensitivity by adjusting the developing bias voltage $V_B$.

As described in detail before, when the photoconductive layer is worn away, the potential at the exposed portion of the layer is not lowered enough. Practically, the surface potential at the exposed portion is not lowered down to $V_i$ but only to $V_i'$, which is higher than the developing bias voltage $V_B$.

Figure 8:
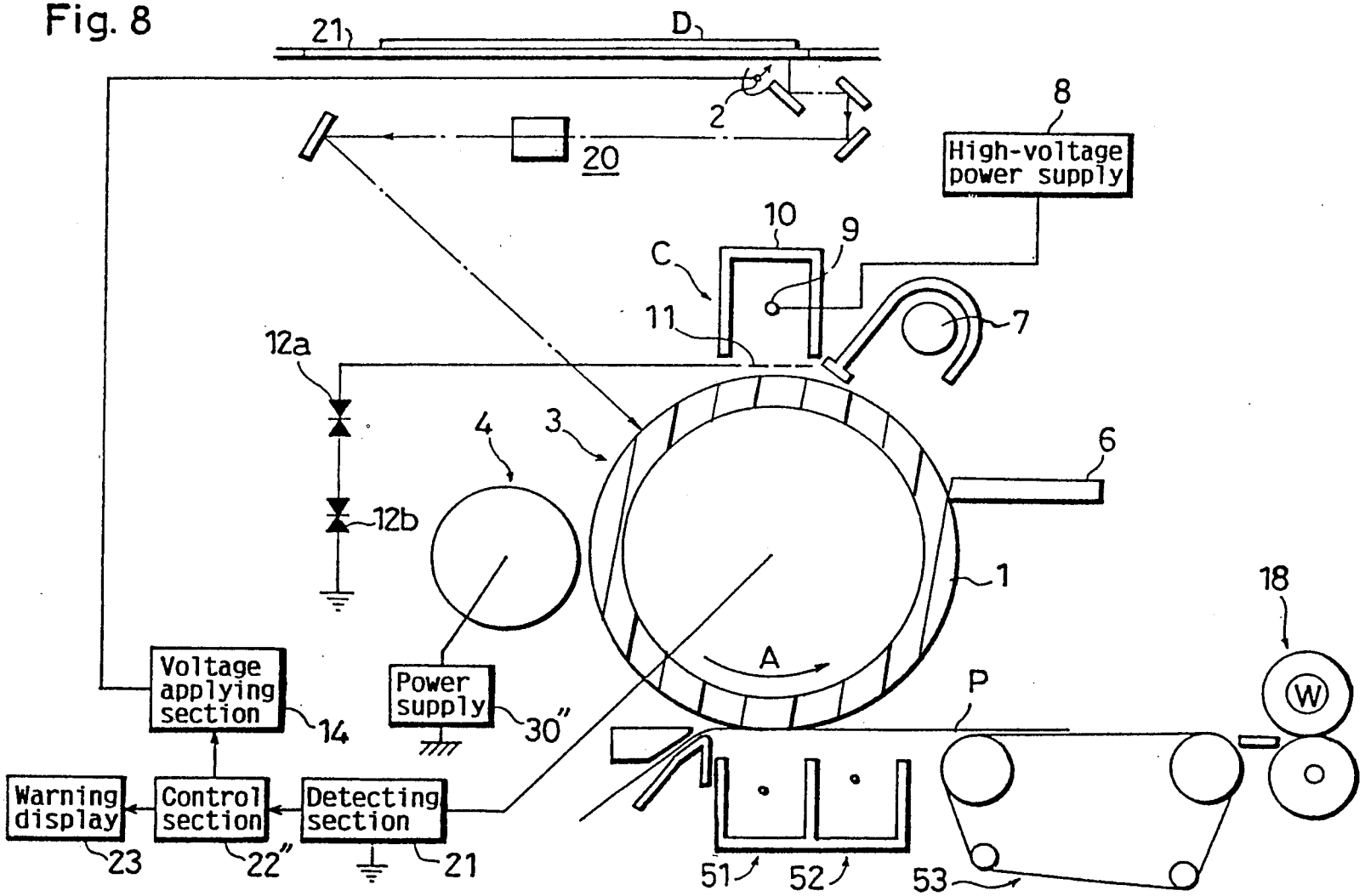
FIG. 8 is a schematic view of a copier as a third embodiment.

In a copier as the third embodiment shown in FIG. 8, a control section 22" sends a developing bias voltage setting signal based on the measured influx current $I_{pc}$ to a power supply 30". Based on the signal, the power supply 30" changes the developing bias voltage to be applied the developing device 4 from $V_B$ to $V_B'$, which is higher than $V_i'$.

In this embodiment, it is not necessary that the exposure lamp 2 allows the light amount to be increased or that the heat generated by the exposure lamp 2 is considered, as distinct from the first and the second embodiments.

The sensitivity compensation may also be done by adjusting the surface potential. The thickness d of the photoconductive layer is assumed based on the measured influx current $I_{pc}$, and a control section controls the output of a main charger based on the measured influx current $I_{pc}$, whereby the surface potential after exposure is lowered than the surface initial potential.

Or the light amount emitted from the exposure lamp, the developing bias voltage and the surface potential may all be adjusted.

This invention is also applicable to a copier equipped with an inorganic photoconductive layer as far as the layer is worn away by repeated image forming procedure. Needless to say, other image forming apparatuses such as an LED printer and a laser printer are covered, in which case, the output level of the print head or the laser diode is adjusted.

Although the present invention has been fully described by way of embodiments with references to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

charging means for uniformly charging a surface of a photoconductive body;

image forming means for forming an image on the photoconductive body charged by said charging means;

detecting means for detecting an influx current flowing into the photoconductive body when the photoconductive body is charged by said charging means; and control means for controlling said image forming means based on a detecting result of said detecting means so as to stabilize a quality of images formed by said image forming means.

2. An image forming apparatus of claim 1, wherein said photoconductive body is organic.

3. An image forming apparatus of claim 1, wherein said charging means is of the scorotron type.

4. An image forming apparatus of claim 3, wherein said charging means have at least two switchable grid voltages and said detecting means detects the influx currents flowing to the photoconductive body corresponding to both of the grid voltages.

5. An image forming apparatus of claim 1, wherein said image forming means includes exposure means for exposing an image of a document on the photoconductive body and said control means controls a light amount emitted from said exposure means for exposure.

6. An image forming apparatus of claim 1, wherein said image forming means includes developing means for developing the image formed on the photoconductive body and said control means controls a developing bias voltage of said developing means.

7. An image forming apparatus comprising:

charging means for uniformly charging a surface of a photoconductive body;

exposure means for exposing an image of a document on the photoconductive body;

developing means for developing the image formed on the photoconductive body;

detecting means for detecting an influx current flowing into the photoconductive body when the photoconductive body is charged by said charging means; and control means for controlling said exposure means based on a detecting result of said detecting means so as to stabilize a quality of images formed on the photoconductive body.

8. An image forming apparatus of claim 7, wherein said photoconductive body is organic.

9. An image forming apparatus of claim 7, wherein said charging means is of the scorotron type.

10. An image forming apparatus of claim 9, wherein said charging means have at least two switchable grid voltages and said detecting means detects the influx currents flowing to the photoconductive body corresponding to both of the grid voltages.

11. An image forming apparatus of claim 7, wherein said control means controls a light amount emitted from said exposure means for exposure.

12. An image forming apparatus of claim 7, wherein said control means further controls a developing bias voltage of said developing means.

13. An image forming apparatus comprising:

charging means for uniformly charging a surface of a photoconductive body;

exposure means for exposing an image of a document on the photoconductive body;

developing means for developing the image formed on the photoconductive body;

detecting means for detecting an influx current flowing into the photoconductive body when the photoconductive body is charged by said charging means; and control means for controlling said developing means based on a detecting result of said detecting means so as to stabilize a quality of images formed on the photoconductive.

14. An image forming apparatus of claim 13, wherein said photoconductive body is organic.

15. An image forming apparatus of claim 13, wherein said charging means is of the scorotron type.

16. An image forming apparatus of claim 15, wherein said charging means have at least two switchable grid voltages and said detecting means detects the influx current flowing into the photoconductive body corresponding to both of the grid voltages.

17. An image forming apparatus of claim 13, wherein said control means controls a developing bias voltage of said developing means.

18. An image forming apparatus of claim 13, wherein said control means further controls said exposure means by adjusting the light amount emitted from said exposure means for exposure.

19. An image forming apparatus comprising:

a scorotron type charger for uniformly charging a surface of a photoconductive body, said charger having at least two switchable grid voltages;

image forming means for forming an image on the photoconductive body charged by said charger;

detecting means for detecting influx currents flowing into the photoconductive body when the photoconductive body is charged by said charger, said detecting means detecting the influx currents flowing into the photoconductive body corresponding to both of the grid voltages; and control means for controlling said image forming means based on a detecting result of said detecting means so as to stabilize a quality of images formed by said image forming means.

20. An image forming apparatus of claim 19, wherein said photoconductive body is organic.

21. An image forming apparatus of claim 19, wherein said image forming means includes exposure means for exposing an image of a document on the photoconductive body and said control means controls a light amount emitted from said exposure means for exposure.

22. An image forming apparatus of claim 19, wherein said image forming means includes developing means for developing the image formed on the photoconductive body and said control means controls a developing bias voltage of said developing means.

23. An image forming apparatus comprising:

charging means for uniformly charging a surface of a photoconductive body;

image forming means for forming an image on the photoconductive body charged by said charging means;

detecting means for detecting an influx current flowing into the photoconductive body when the photoconductive body is charged by said charging means;

estimating means for estimating a life expectancy of the photoconductive body based on a detecting result of said detecting means; and warning means for warning an operator when the photoconductive body completes a life thereof in accordance with said estimating means.

24. An image forming apparatus of claim 23, wherein said photoconductive body is organic.

25. An image forming apparatus of claim 23, wherein said estimating means calculates a thickness of a photoconductive layer of the photoconductive body and estimates the life expectancy of the photoconductive body from calculated thickness.

26. An image forming apparatus of claim 24, wherein said estimating means further estimates a number of copies which can be made hereafter from the calculated thickness and a number of copies which have been made.

27. An image forming apparatus of claim 23, further comprising:

control means for controlling said image forming means based on a detecting result of said detecting means so as to stabilize a quality of images formed by said image forming means.

28. An image forming apparatus of claim 27, wherein said image forming means includes exposure means for exposing an image of a document on the photoconductive body and said control means controls a light amount emitted from said exposure means for exposure.

29. An image forming apparatus of claim 27, wherein said image forming means includes developing means for developing the image formed on the photoconductive body and said control means controls a developing bias voltage of said developing means.

30. An image forming apparatus comprising:

charging means for uniformly charging a surface of a photoconductive body;

image forming means for forming an image on the photoconductive body charged by said charging means;

detecting means for detecting an influx current flowing into the photoconductive body when the photoconductive body is charged by said charging means;

calculating means for calculating a number of copies which can be made hereafter based on a detecting result of said detecting means; and informing means for informing an operator of the calculated number of copies.

31. An image forming apparatus of claim 30, wherein said photoconductive body is organic.

32. An image forming apparatus of claim 30, wherein said calculating means calculates a thickness of a photoconductive layer of the photoconductive body and thereafter calculates the number of copies which can be made hereafter from the calculated thickness.

33. An image forming apparatus of claim 30, further comprising:

control means for controlling said image forming means based on a detecting result of said detecting means so as to stabilize a quality of images formed by said image forming means.

34. An image forming apparatus of claim 33, wherein said image forming means includes exposure means for exposing an image of a document on the photoconductive body and said control means controls a light amount emitted from said exposure means for exposure.

35. An image forming apparatus of claim 33, wherein said image forming means includes developing means for developing the image formed on the photoconductive body and said control means controls a developing bias voltage of said developing means.

36. An image forming apparatus comprising:

a rotatable photoconductive member;

charging means for uniformly charging a surface of said photoconductive member at a predetermined potential;

image forming means for forming an image on a sheet, said image forming means including exposing means for exposing an image on the photoconductive member charged by said charging means to form an electrostatic latent image thereon, developing means for developing the electrostatic latent image into a toner image and transferring means for transferring the toner image on a sheet;

detecting means for detecting an influx current flowing into the photoconductive member when the photoconductive member is charged by said charging means; and control means for controlling said image forming means based on a detecting result of said detecting means.

37. An image forming apparatus of claim 36, wherein said charging means includes a scorotron charger having a charging wire accommodated in a casing and a grid electrode interposed between the charging wire and the photoconductive member, a potential of said grid electrode being kept at a predetermined potential.

38. An image forming apparatus of claim 37, wherein said control means controls exposing means.

39. An image forming apparatus of claim 37, wherein said control means controls developing means.

* * * * *

UNITED STATES PATENT AND TRADEMARK OFFICE

CERTIFICATE OF CORRECTION

PATENT NO. : 5,159,388

DATED : October 27, 1992

INVENTOR(S) : Yoshiyama, et al.

It is certified that error appears in the above-identified patent and that said Letters Patent is hereby corrected as shown below:

In col. 7, last line, change "22°" to --22′--.

In col. 8, lines 33-35, delete equation (16) in its entirety and insert the following:

$$-- \; E^1_0 = \left\{ \frac{I^1_{pc(a+b)} - I^1_{pc(a)}}{I^0_{pc(a+b)} - I^0_{pc(a)}} \right\}^{0.8} E^0_0$$

In col. 8, line 40, change "$I_{pc(a+b)}0$" to --$I_{pc(a)}0$--.

In col. 10, line 48 (claim 13, last line), after "photoconductive" insert --body--.

Signed and Sealed this

Nineteenth Day of October, 1993

Bruce Lehman

*Attest:*

BRUCE LEHMAN

*Attesting Officer*

*Commissioner of Patents and Trademarks*